United States Patent [19]

Gurtler

[11] 4,126,160

[45] Nov. 21, 1978

[54] CHEMICAL INDUCTOR AND CAN CRUSHER

[76] Inventor: Wendell Gurtler, Sheldon, Iowa 51201

[21] Appl. No.: 806,092

[22] Filed: Jun. 13, 1977

[51] Int. Cl.[2] ..... B65B 3/04; B67B 7/24

[52] U.S. Cl. ..... 141/91; 100/DIG. 2; 134/167 R; 141/95; 141/330; 222/88

[58] Field of Search ..... 127/240; 128/31; 134/167 R, 168 R; 141/1, 98, 292, 329, 330, 89, 90, 94, 95, 91; 222/80, 81, 82, 83, 83.5, 86, 87, 88, 148, 145, 149, 151, 155; 100/DIG. 2; 241/99

[56] References Cited

U.S. PATENT DOCUMENTS

| | | | |
|---|---|---|---|
| 2,139,143 | 12/1938 | Wiswell | 222/87 X |
| 3,472,451 | 10/1969 | Orem et al. | 134/167 R X |
| 3,993,221 | 11/1976 | Boynton et al. | 222/87 |

*Primary Examiner*—Richard E. Aegerter
*Assistant Examiner*—Frederick R. Schmidt

[57] ABSTRACT

A can crushing and emptying device adapted to crush and drain large cans by cutting out one end, draining the contents into a container, flushing the can and then crushing it by means of a ram adapted to press the can onto a ring of sharpened teeth arranged to contact the end of the can near its perimeter. Levers are provided to move the end of the can into the interior of the can. A nozzle is provided to rinse the interior, and a support for the perimeter of the can is used to resist the force of the ram whereby the exterior of the can is crushed between the support and the ram.

7 Claims, 4 Drawing Figures

CHEMICAL INDUCTOR AND CAN CRUSHER

BACKGROUND AND SUMMARY OF THE INVENTION

This invention pertains to devices for disposing of containers for liquid materials and more particularly to the emptying and disposing of metal cans of larger sizes used for holding farm chemicals and the like.

Many farm chemicals, particularly chemical herbicides, pesticides and the like are shipped and sold in metal containers or cans containing amounts of the order of 5 gallons. These cans usually hold concentrated material which is to be diluted with water to a strength usable in a mechanical sprayer or other applicator.

Some containers are provided with a spout or the like for pouring. However, this provision adds considerably to the cost of the container. Further, it is highly undesirable to reuse the containers unless one is absolutely certain the same material is used in the container. Residues of the former material in the container could be highly damaging if applied with a different material for a different purpose. For example, assume a can originally contained a herbicide effective against broadleafed plants, and residues remained in the can; and the can were then refilled with a herbicide usable against grasses. If the mixture were then applied to a broadleafed crop such as soybeans, the residue of the original material could have a serious effect on the broadleafed crop. Therefore, destruction of such a container is desirable.

However, opening and emptying of a completely sealed 5-gallon can is also a difficult task with methods presently available. It is by my invention that such opening and emptying is made simple. I accomplish this by means of a device adapted to cut open one end of the can, to move the cut-open end out of the way so that the can will drain into a tank. The can can then be crushed for disposal or recycling.

FIGURES

DESCRIPTION

Figure 1:
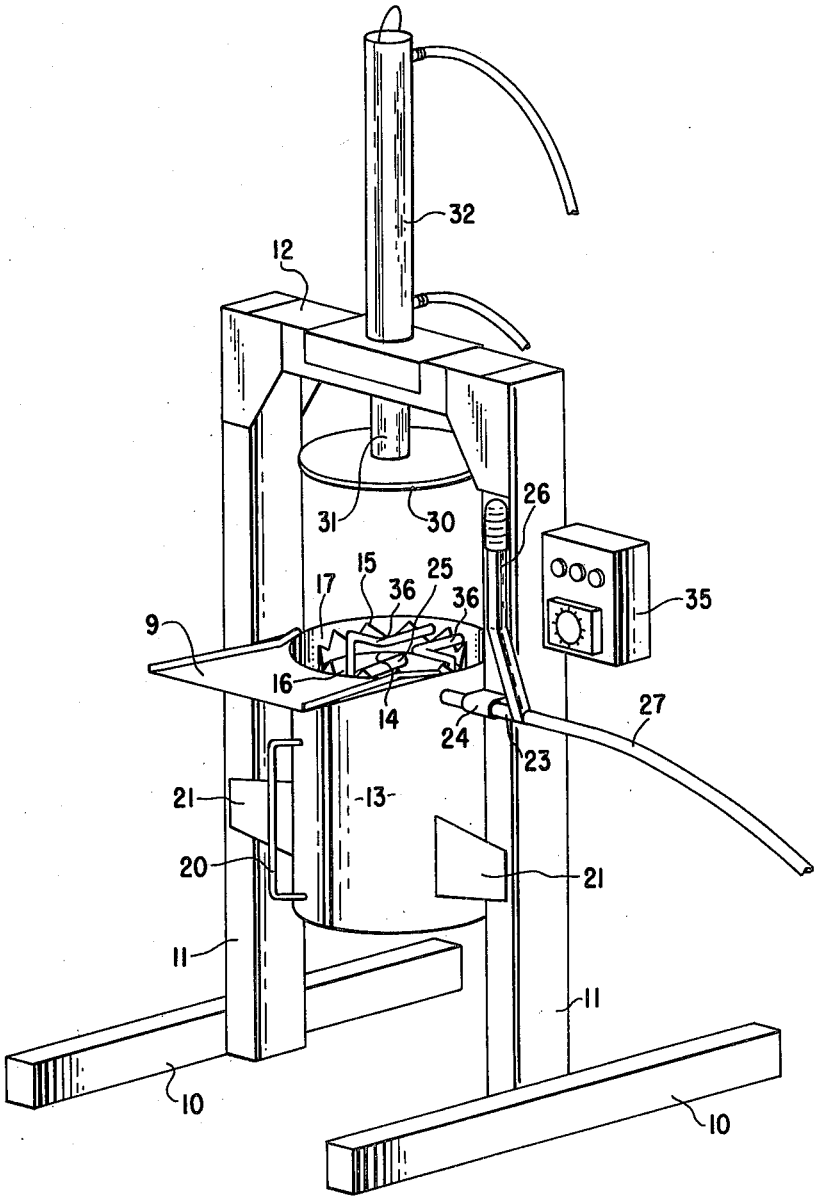
FIG. 1 is a pictorial view of the device of my invention.
Figure 2:
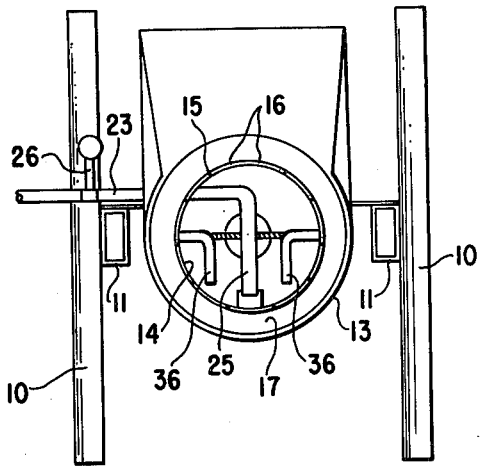
FIG. 2 is a view of the top of the cutting device and parts beneath it.

Briefly my device comprises a stand on which is mounted a tank or container.

Above the container is a ring of cutting knives adapted to cut the end out of a can, and means is provided to press the can onto the knives to open it. Other means may be provided to rinse out the can and to push the cut off end into the emptied can so that the rinsing material can properly spray the inside of the can.

More specifically, and referring to the drawings, I provide a supporting frame including feet 10 and uprights 11 joined together at the top by a crossbeam 12. A container 13 of sufficient size to receive all the contents of the type of can to be crushed plus a sufficient quantity of diluent is supported by the frame from plates 21 or the like bolted to the uprights 11 and welded to the container.

At its upper end, the container 13 is formed with an opening 14 surrounded by a serrated knife 15. The knife does not extend totally around the circumference of the opening 14, but is formed to leave a gap 16. A seal 17 formed of rubber or similar material is fitted around the knife to seal the can to be crushed against the top of the container. A tray 9 having a surface at the approximate level of the top of the teeth of the knife may be provided to support the can - particularly before it is opened and drained.

Figure 3:
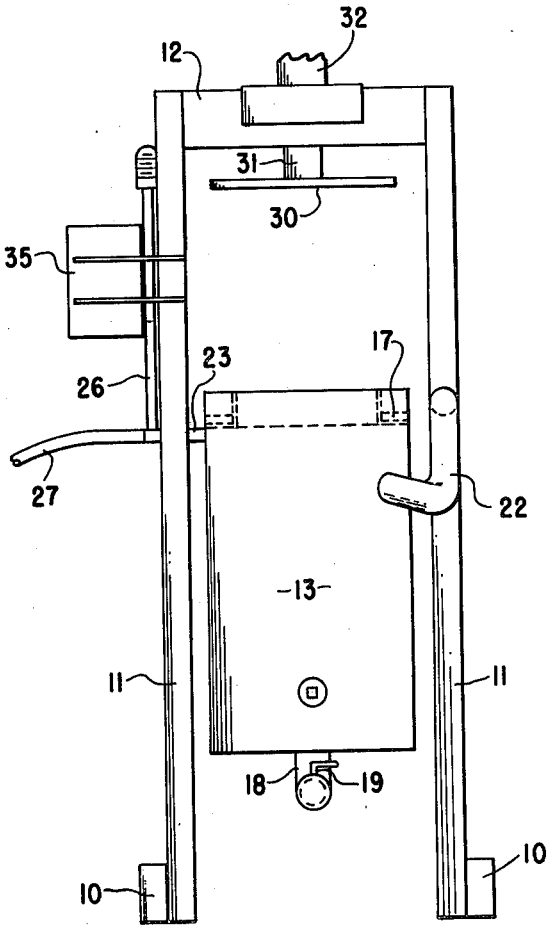
FIG. 3 is a rear elevational view of the device.
Figure 4:
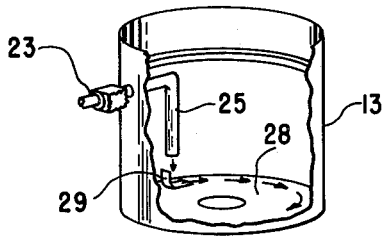
FIG. 4 is a view of the container with part of the wall broken away to show interior parts.

The container 13 is drained through an outlet pipe 18 which may be controlled by a valve 19. A sight gage 20 may also be used to provide an indication of the level of contents in the container. If materials are to be used which may require different amounts of diluent, or if varying strengths of the material may be desired, then a graduated sight gage, or a scale on the container adjacent the gage should be provided. An air vent 22 (FIG. 3) may also be provided to allow quick discharge of the material from the can into the container.

A rigid pipe 23 is pivotally journalled in a bracket 24 on one upright 11, and extends into the container, terminating in a portion 25 bent at right angles to the entering pipe, thus forming a nozzle adapted to direct a stream of liquid into the can. A handle 26 attached to the pipe 23 forms a lever by which the pipe may be pivoted to rock the end portion 25 from a substantially horizontal position as shown to a substantially vertical position pointed either up or down. A flexible hose 27 is connected with the pipe so that a liquid to be used as a diluent may be forced therethrough.

Within the container 13, my preferred embodiment includes a means making possible the use of the device with a wettable power. This means includes a diverting vane 29 mounted on the bottom 28 of the container 13 in position such that the stream from the end 25 of the pipe may be directed against the vane. The impingement of the stream on the vane will cause the fluid to swirl inside the container 13. This motion of the fluid in the container rinses the container so that full mixing takes place. Also, the motion makes possible the use of the device with cans of wettable powder. The powder drops into the container 13 and by the swirling motion of the stream of liquid it is completely mixed before dropping from the outlet pipe 18.

A ram consisting of a plate 30 and a post 31 extends downward from the crossbeam 12. The ram is operated from a double-acting hydraulic cylinder 32 fixed to the crossbeam. The plate is of proper size to extend somewhat beyond the edges of the can to be crushed.

In operation, a full can may be placed on the tray 9 and then slid into proper location on the knife 15 so that the knife points are around the periphery of the top (or bottom) of the can. The ram is then actuated to force the can onto the knife, cutting completely around the end of the can except for the narrow strip left by the gap 16 in the knife. The pressure of the ram presses the edges of the can against the seal 17 so that the contents of can will discharge into the container with only minimum spillage, and to prevent leakage of fumes from the container.

Before the can is completely crushed, the lever 26 may be operated to bring the end 25 up against the nearly severed end of the can. This operation will fold the end of the can upward within the can to move it out of the way of discharging contents, and to allow the can to be rinsed. The rinsing or flushing is accomplished by running the diluting material (ordinarily water) through the hose 27 and pipe 23 and out of the end or nozzle 25 within the can. Proper dilution is determined either from the sight gage 20 or by timing the flow by use of a timing device 35. This device may be a simple timer to be watched by the operator, or may be arranged for automatic use so that a timed flow is automatically started by operating the lever 26 and stopped by the timer.

The can may be completely crushed by the operation of the ram after flushing is complete. Spring loaded discharge arms 36 may be provided to push the crushed can off the knife 15. In the upper position, the upper surface of these arms is just above the level of the serrated teeth of the knife 15. Thus, they will support the can as it is slid into place over the knife. These arms are biased upwardly by a relatively heavy spring within the container so that upon release of the pressure from the ram, they will effectively move the crushed can off from the teeth of the knife 15.

What is claimed is:

1. A device for crushing and emptying a can comprising support means, a container supported by said support means, knife means on said container arranged to nearly surround an opening at the top of said container said opening being of such size that said knife means is adapted to engage the end of said can near its outer rim, and ram means on said support means positioned above said knife means whereby a can set upon said knife means will be pressed thereonto and crushed by said ram in which bracket means on said support means provides for pivotal mounting, pipe means being pivotally mounted in said bracket means and extending into the interior of said container, said pipe means having an end at right angles to the pivotal axis, said end being long enough such that pivotal motion of said pipe about its pivotal axis will carry the termination of said end to a point above said opening at the top of the container, said pipe being therefore in position to flush the interior of said can.

2. The device of claim 1 in which hose means is connected to said pipe means whereby a fluid may be forced through said pipe means and outward of said end.

3. The device of claim 2 in which vane means are mounted on the bottom of said container in position beneath said end of said pipe means whereby said stream will be deflected to cause a swirling motion of the fluid in the container.

4. The device of claim 1 in which said ram is hydraulically operated.

5. The device of claim 1 in which said knife means is formed with serrated teeth.

6. The device of claim 1 in which said knife means is formed with a gap to provide for less than complete surrounding of said opening and in which said pipe is pivoted on an axis so that the end of said pipe moves upward and in the direction toward said gap and engages the end of a can cut by said knife means thereby folding said end; upward within said can.

7. The device of claim 1 in which said container is provided with drain means and with a sight gage whereby the level of liquid in said container may be determined.

* * * * *